United States Patent [19]

Yotsumoto et al.

[11] 4,378,453

[45] Mar. 29, 1983

[54] ADHESIVE FOR POLYESTER FIBROUS MATERIAL

[75] Inventors: Toshihiro Yotsumoto, Higashimurayama; Kazuo Koyama, Sayama, both of Japan

[73] Assignee: Bridgestone Tire Co., Ltd., Tokyo, Japan

[21] Appl. No.: 366,017

[22] Filed: Apr. 6, 1982

[30] Foreign Application Priority Data

Apr. 10, 1981 [JP] Japan ..... 56-52934

[51] Int. Cl.[3] ..... C08G 8/20; C08G 8/22; C08G 8/24

[52] U.S. Cl. ..... 525/442; 525/501; 528/137; 528/143; 528/144; 528/147; 528/153; 528/155; 428/480; 428/482

[58] Field of Search ..... 528/153, 155, 137, 147, 528/143, 144; 525/442, 501

[56] References Cited

U.S. PATENT DOCUMENTS

| | | | |
|---|---|---|---|
| 2,477,641 | 8/1949 | Nagel | 528/155 X |
| 2,878,198 | 3/1959 | Ingram et al. | 528/147 X |
| 3,437,610 | 4/1969 | Mouit | 528/155 X |
| 3,835,082 | 9/1974 | Wright | 528/155 X |
| 4,009,304 | 2/1977 | Dixon et al. | 528/155 X |
| 4,112,160 | 9/1978 | Kako et al. | 528/155 X |

*Primary Examiner*—Howard E. Schain
*Attorney, Agent, or Firm*—Sughrue, Mion, Zinn, Macpeak and Seas

[57] ABSTRACT

An adhesive consisting comprising an alkoxyphenol derivative/resorcin derivative/formaldehyde cocondensate has a high adhesive strength and can bond firmly polyester fibrous material with rubber.

3 Claims, No Drawings

ADHESIVE FOR POLYESTER FIBROUS MATERIAL

BACKGROUND OF THE INVENTION

1. Field of the Invention

The present invention relates to an adhesive for polyester fibrous material, and more particularly relates to a novel adhesive capable of bonding strongly polyester fibrous material with rubber and having high resistance against deterioration during the use at high temperature.

2. Description of the Prior Art

Polyester materials, such as polyethylene terephthalate and the like, which are linear polymers having ester linkages in the main chain, are superior to nylon material and the like in the retention of stable dynamic properties, for example, low stress relaxation, low creep property and good recovery after stretching. Therefore, polyester material is very advantageously used as a reinforcing material for rubber articles, such as tire, belt, air cushion, rubber hose and the like, in the form of a filament, yarn, cord, cable, cord fabric, canvas and the like.

However, polyester has a dense hyper-structure and a small number of functional groups, and therefore when it is intended to use polyester material as a reinforcing material for these rubber articles, polyester material can not be satisfactorily bonded to rubber by means of RFL liquid comprising resorcin/formaldehyde initial condensate and rubber latex and being an adhesive capable of bonding strongly nylon material, rayon material and the like to rubber.

In order to obviate this drawback, there have hitherto been proposed a method, wherein polyester surface is treated with alkali or amine to increase the number of active groups, such as —OH, —COOH, $NR_2$ groups and the like, wherein R represents a hydrogen atom or an alkyl group, on the surface, and then the polyester is treated with RFL; and a method, wherein a functional group having a bonding ability with hydrogen or capable of forming primary bond is introduced into polyester surface by an isocyanate compound or epoxy compound, and then the polyester is treated with RFL; and various adhesive compositions used for these methods.

However, isocyanate compound and epoxy compound have a high reactivity and react with water and RF, which water is used as a solvent for RFL, and therefore it is difficult to use isocyanate compound or epoxy compound in a one-bath system adhesive liquid. In order to obviate this drawback, the treatment for polyester with the adhesive must be carried out in two stages. However, a more complicated installation and a larger amount of heat are required in the two stage treatment, and the two stage treatment is not preferable in view of the resource saving and energy saving. Moreover, epoxy compound and isocyanate compound fume in a large amount during the heat treatment, and are not preferable in view of environmental pollution and public nuisance. In addition, polyester fiber is hardened by a pretreatment with an epoxy compound or isocyanate compound, and it is difficult to treat the polyester fiber. As a result, rubber articles reinforced with polyester fibers treated with the adhesive containing an epoxy compound or isocyanate compound are short in the life, and when the rubber articles are used under high strain or at high temperature, the adhesive layer deteriorates rapidly.

While, as an adhesive for polyester fibrous materials, which can treat them in one stage in a one bath system, there have been proposed an adhesive, which uses a tricyclic cocondensate formed of a resorcin derivative and a phenol derivative in combination with RFL (Japanese Patent Application Publication No. 11,251/71); an adhesive, which uses a methylolated reaction product of an active methylene group-containing p-substituted phenol (oligomer) with resorcin in combination with RFL (Japanese Patent Application Publication No. 39,567/72). However, these adhesives are still insufficient in the adhesive strength required in the rubber industry.

SUMMARY OF THE INVENTION

It is an object of the present invention to provide an adhesive, which develops a high adhesive strength by a one stage treatment, is low in the deterioration of the adhesive strength during the use at high temperature, and can produce a flexible cord by the treatment with the adhesive. The adhesive of the present invention comprises a cocondensate of a m-alkoxyphenol derivative, a resorcin derivative and formaldehyde.

That is, the feature of the present invention lies in an adhesive for polyester fibrous material, comprising an alkoxyphenol, derivative/resorcin derivative/formaldehyde cocondensate, which is obtained by condensing.

a compound represented by the following general formula (I)

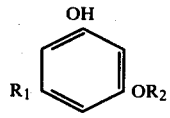

(I)

wherein $R_1$ represents a hydrogen atom or an alkyl group having 1–3 cabon atoms, and $R_2$ represents an alkyl group having 1–4 carbon atoms, and a compound represented by the following general formula (II)

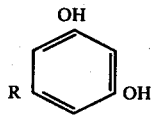

(II)

wherein R represents a hydrogen atom or an alkyl group having 1–3 carbon atoms, together with formaldehyde in the presence of an acidic catalyst.

DESCRIPTION OF THE PREFERRED EMBODIMENT

The upper limits of the carbon numbers of the substituents $R_1$ and $R_2$ in the alkoxyphenol derivative represented by the general formula (I) are 3 and 4, respectively. When the carbon numbers exceed these upper limits, the resulting cocondensate is poor in the reactivity with RF or in the affinity to polyester and can not exhibit a sufficiently high adhesive strength. As the compound represented by the formula (I), mention may be made of m-methoxyphenol, m-ethoxyphenol, m-propoxyphenol, m-butoxyphenol, 3-methoxy-5-methyl-phenol, 3-methoxy-5-ethylphenol, 3-methoxy-5-propylphenol and the like.

The upper limit of the carbon number of the substituent R in the resorcin derivative represented by the general formula (II) is 3. This upper limit is necessary in order that the resulting adhesive exhibits an excellent adhesive strength similarly to the case of the alkoxyphenol derivative represented by the general formula (I). As the compound represented by the formula (II), mention may be made of resorcin, 5-methylresorcin, 5-ethylresorcin, 5-propylresorcin and the like.

As the method for producing the cocondensate of the present invention, there can be used any of the following methods, that is, a method wherein water and an acidic catalyst, such as hydrochloric acid, sulfuric acid, oxalic acid or the like, are added to a mixture of m-alkoxyphenol derivative and resorcin derivative, and then 37% aqueous formaldehyde solution is added dropwise to the reaction system to obtain the cocondensate in one stage reaction; a method wherein formaldehyde is previously added to a m-alkoxyphenol derivative in the presence of an alkaline catalyst, such as NaOH, KOH or the like, and then the addition product is reacted with a resorcin derivative in an acidic medium; a method wherein a m-alkoxyphenol derivative and a resorcin derivative are used in a reverse order in the above described method; and the like.

According to the analysis of molecular weight distribution by means of an analytical instrument for molecular weight, such as GPC or the like, the m-alkoxyphenol derivative/resorcin derivative/formaldehyde cocondensate of the present invention has a molecular weight distribution extending over a certain range similarly to a condensate of the other hydroxybenzene with formaldehyde. However, a cocondensate having a molecular weight within the range of 300–600 is effectively used as an adhesive. In the present invention, it is preferable that a cocondensate having a molecular weight within this range is selectively used, or a cocondensate consisting mainly of a cocondensate having a molecular weight within this range is used. When a cocondensate has a molecular weight less than 300 or more than 600, the resulting adhesive is poor in the penetration into polyester and does not exhibit effectively an adhesive strength. The molar ratio of m-alkoxyphenol derivative to resorcin derivative is generally within the range of 2/1-1/4, preferably 1/1-1/3.

The cocondensate of the present invention is adhered to polyester fibrous material in the following manner in the bonding of the fibrous material with rubber. The cocondensate of the present invention is used togerher with RFL, which is a commonly known vulcanizable adhesive assistant. The cocondensate can be adhered to polyester fibrous material in any of one stage treatment and two stage treatment, and it is preferable to dilute the adhesive with water prior to the treatment of the fibrous material with the adhesive.

Among the cocondensates of the present invention, cocondensates of m-alkoxyphenol having a total number of carbon atoms of not larger than 2 in its substituents, that is, m-methoxyphenol, m-ethoxyphenol or 3-methoxy-5-methylphenol, with resorcin and formaldehyde dissolve in alkaline water, but cocondensates of the other m-alkoxyphenol with resorcin and formaldehyde or cocondensates of m-alkoxyphenol with alkylresorcin and formaldehyde, that is, cocondensates having a larger number of carbon atoms in the substituents of benzene ring have a poorer solubility in alkaline water.

Among the cocondensates of the present invention, ones soluble in alkaline water is dissolved in water by using sodium hydroxide, potassium hydroxide, hydroxides of alkaline earth metal, ammonium hydroxide and an organic amine such as monomethylamine or the like, and then diluted with water. The most preferable alkaline substance is ammonium hydroxide.

While, cocondensates having a poor solubility in water can be dispersed in water by using an optional anionic surfactant by means of a dispersing apparatus, such as ball mill, sand mill or the like. In this case, it is necessary that the surfactant is used in an amount of as small as possible in order to develop effectively the adhesive strength of the cocondensate in so far as the dispersed state is not deteriorated.

In the one stage treatment, an aqueous solution or aqueous dispersion of the above described cocondensate is mixed with RFL to form an adhesive composition liquid of the present invention. The mixing ratio of the cocondensate to RFL is within the range of 25/100-125/100 (in solid basis and weight ratio). When the mixing ratio is lower than the lower limited or is higher than the upper limit of the above described mixing ratio, the resulting adhesive composition liquid is poor in the adhesive strength.

The above obtained adhesive composition liquid (hereinafter, referred to as adhesive liquid) is adhered to a polyester fibrous material to produce an adhesive-treated polyester fibrous material. The above treated fibrous material is contacted with vulcanizable unvaulcanized rubber, and the resulting mass is vulcanized, whereby the rubber can be firmly bonded to the polyester fibrous material. As the method for adhering the adhesive liquid to the polyester fibrous material, there can be used a method wherein the fibrous material is immersed in the adhesive liquid; a method wherein the adhesive liquid is applied to or sprayed on the fibrous material; and the like. These methods can be properly selected depending upon the purpose.

After the adhesive liquid is adhered to the fibrous material, the fibrous material is heat treated to produce an adhesive-treated polyester fibrous material. This heat treatment is carried out at a temperature of not lower than 200° C., preferably 220°–250° C. The reason is as follows. The adhesive of the present invention exhibits its adhesive strength after the adhesive has been diffused into polyester fiber. As the treating temperature is higher, more excellent result can be obtained. When the temperature is lower than 200° C., the diffusing property of the adhesive is very poor. While, when the temperature is higher than 250° C., polyester fiber is deteriorated and is decreased in its strength and a satisfactory result can not be obtained. In the treatment by an ordinary adhesive, a drying treatment is carried out at a temperature of not higher than 200° C. in order to volatilize the solvent before this heat treatment. In the present invention also, this drying treatment can be carried out before the heat treatment.

The RFL to be used in the present invention can be produced in the following manner. A mixture of resorcin and formaldehyde in a mixing ratio within the range of 1.0/0.8-1/7 (molar ratio) is matured for several hours in the presence of an alkali catalyst (for example, sodium hydroxide, potassium hydroxide, ammonium hydroxide, urea, thiourea and the like), the matured mixture is mixed with rubber latex in a mixing ratio within the range of 1/100-35/100 (weight ratio), and the resulting mixture is further matured for several hours. Alternatively, resorcin, formaldehyde and rubber latex are all mixed in the above described mixing ratio, and the resulting mixture is matured. The amount of the alkali catalyst to be used is adjusted so as to obtain an RFL having a pH within the range of 8.5–12.0. A particularly preferable catalyst is ammonium hydroxide. In this case, it is preferable to prepare firstly a mixture of resorcin, formaldehyde and rubber latex, and then to mature the mixture. As the rubber latex to be used in the RFL, use is made of at least one of natural rubber latex and synthetic rubber latexes, such as styrene/butadiene copolymer rubber latex, styrene/vinylpyridine/butadiene copolymer rubber latex and the like. The kind of the rubber latex is generally determined depending upon the kind of rubber be bonded.

When the cocondensate according to the present invention is adhered to polyester fibrous material in the two stage treatment, the polyester fibrous material is immersed in an aqueous alkali solution or aqueous dispersion of the cocondensate, or in an aqueous solution containing the cocondensate and an organic solvent, such as alcohol or the like (organic solvent is used in place of surfactant in the one stage treatment); the fibrous material is heat treated at a temperature of 220°–250° C. and then immersed in an RFL liquid to adhere the RFL to the fibrous material; and the above treated fibrous material is again heat treated at a temperature of 200°–250° C. In the two stage treatment, since the cocondensate has been fully diffused into the polyester fibrous material during the first stage heat treatment by the cocondensate, a satisfactorily high adhesive strength of the cocondensate can be obtained by the second stage heat treatment, at a temperature of 200°–250° C., of the fibrous material having the RFL adhered thereto.

Resin formed by the cocondensate of the present invention, or resin formed by a mixture of the cocondensate and RFL is very flexible, and therefore the resin does not harden cords. Moreover, since the cocondensate has a high affinity to polyester fibrous material and further has a high diffusing property thereinto, a large amount of the cocondensate is diffused on the surface of the polyester fibrous material. Furthermore, since the cocondensate has a large amount of functional groups and a high reactivity, the cocondensate is reacted with the RF in the RFL to form a polymer having a cross-linked structure, whereby the cocondensate is very firmly bonded to the polyester fibrous material. Therefore, the cocondensate exhibits a very high adhesive strength as compared with conventional adhesive.

In order to increase the adhesive strength of the cocondensate of the present invention, the cocondensate can be used together with carriers, which are used at the dyeing of polyester and have an effect for weakening the bonding force between the molecular chains of polyester and an effect for diffusing molecules of foreign substances, such as the cocondensate and the like, between the molecular chains of polyester, or with swelling agents having a high diffusing property into polyester and an effect for swelling between the molecular chains of polyester. As the carriers, use is made of benzoic acid, methyl benzoate, propyl benzoate, salicylic acid, methyl salicylate, acetophenone, propiophenone, phenol, p-chlorophenol, p-nitrophenol, monochlorobenzene, dichlorobenzene, trichlorobenzene, dibromobenzene and the like. As the swelling agent, use is made of 3,5-xylenol/formaldehyde condensate, t-butylphenol/cresol/formaldehyde condensate, m-methoxybenzoic acid/formaldehyde condensate, t-butylphenol/formaldehyde condensate, 1,1'-bis-(2,4-dihydoxyphenyl) disulfide and the like. The ratio of the cocondensate to the carrier or swelling agent is preferably within the range of 100/15-100/20 (weight ratio). When the carrier or swelling agent is water soluble, they are directly dissolved in water and used; while when they are insoluble in water, they are dispersed in water in the presence of a proper anionic surfactant and used.

The following examples are given for the purpose of illustration of this invention and are not intended as limitations thereof. In the examples, "parts" and "%" mean by weight.

EXAMPLE 1

Into a reactor equipped with a thermometer, an agitator, a reflux apparatus and a dropping funnel were charged 124 parts (1 mol) of m-methoxyphenol, 0.62 part of oxalic acid and 248 parts of acetone, and 23.4 parts of 37% aqueous formaldehyde solution was added dropwise to the mixture in 1 hour while agitating the resulting mixture at 60° C. Immediately after completion of the addition, 62 parts (0.5 mol) of resorcin and 0.31 part of oxalic acid were added to the mixture, and then 39.2 parts of 37% aqueous formaldehyde solution was added to the mixture in 2 hours while agitating the resulting mixture at 60° C., and further an agitation was continued for 3 hours at 60° C. Then, acetone and water were removed from the reaction solution, the residue was charged into a distillator, and unreacted m-methoxyphenol and resorcin were removed by a distillation under reduced pressure to obtain a m-methoxyphenol/resorcin/formaldehyde cocondensate.

The resulting m-methoxyphenol/resorcin/formaldehyde cocondensate was sampled in an amount of 15 parts in solid basis, and 10.5 parts of 28% aqueous ammonium hydroxide solution was added to the sampled cocondensate, and further water was added to the mixture to make the total amount of the resulting mixture up to 100 parts to obtain an aqueous ammonia solution of the m-methoxyphenol/resorcin/formaldehyde cocondensate. 75 parts of the aqueous ammonia solution of the cocondensate was mixed with 100 parts of an RFL having a composition shown in the following Table 1 to produce an adhesive liquid. This RFL had previously been produced by aging for 48 hours a mixture having the following composition.

TABLE 1

| | Parts |
|---|---|
| Water | 518.8 |
| Resorcin | 11.0 |
| Formaldehyde (37%) | 16.2 |
| Ammonium hydroxide (28%) | 10.0 |
| Vinylpyridine/styrene/butadiene copolymer rubber latex (41%) | 244.0 |

As a polyester fibrous material, there was used a polyethylene terephthalate tire cord having a twist structure of 1,500 d/2, a ply twist number of 40 turns/10 cm and a cable twist number of 40 turns/10 cm. The tire cord was immersed in the above described adhesive liquid, dried at 150° C. for 1.5 minutes and then heat treated for 2 minutes under an air atmosphere kept at 240° C. The adhesive strength of the adhesive was evaluated by using a rubber composition having a compounding recipe shown in the following Table 2.

TABLE 2

| | Parts |
|---|---|
| Natural rubber | 80 |
| Styrene/butadiene copolymer rubber | 20 |
| Carbon black | 40 |
| Stearic acid | 2 |
| Petroleum series softener | 10 |
| Pine tar | 4 |
| Zinc oxide | 5 |
| N—Phenyl-β-naphthylamine | 1.5 |
| 2-Benzothiazyl disulfide | 0.75 |
| Diphenylquanidine | 0.75 |
| Sulfur | 2.5 |

The adhesive strength was evaluated in the following mannr. The cord treated with the above described adhesive liquid was embedded in the unvulcanized rubber composition shown in the above Table 2, and the mass was vulcanized at 145° C. for 30 minutes under a pressure of 20 kg/cm$^2$. Then, the cord was digged out from the vulcanizate and peeled from the vulcanizate at a rate of 30 cm/min to measure the peeling resistance, which was the adhesive strength (kg/cord) of the adhesive. The obtained results are shown in Table 3.

EXAMPLES 2-8 AND COMPARATIVE EXAMPLES 1 AND 2

The same adhesive liquids as the adhesive liquid described in Example 1 were produced in the same manner as described in Example 1, except that the alkoxyphenol component of m-methoxyphenol/resorcin/formaldehyde cocondensate used in Example 1 was varied (Examples 2-5 and Comparative example 1), and the resorcin component thereof was varied (Examples 6-8 and Comparative example 2), and the adhesive strength of the adhesive was evaluated in the same manner as described in Example 1. The obtained results are shown in Table 3. (In Table 3, the amount (parts by weight) of the alkoxyphenol component or resorcin component is described in the parentheses below the component).

The resulting cocondensates in Examples 3, 4, 7 and 8 and Comparative examples 1 and 2 were insoluble in alkaline water, and therefore 15 parts of the cocondensate was mixed with 1.5 parts of Demol EP (trademark of anionic surfactant sold by Kao Atlas Co.) and 83.5 parts of water, and the resulting mixture was charged into a laboratory sand grinder and agitated at high speed together with glass beads to produce an aqueous dispersion containing 15% of the solid substance of the cocondensate.

COMPARATIVE EXAMPLE 3

The same adhesive liquid as described in Example 1 was produced by using a resorcin/formaldehyde condensate, which had been obtained by reacting resorcin with formaldehyde in the presence of an acidic catalyst, in place of the m-methoxyphenol/resorcin/formaldehyde cocondensate used in Example 1, and the adhesive strength of the adhesive was evaluated in the same manner as described in Example 1. The obtained results are shown in Table 3.

EXAMPLE 9

A polyester tire cord having the same twist structure as described in Example 1 was treated with the same m-methoxyphenol/resorcin/formaldehyde cocondensate and RFL as described in Example 1 in a two stage treatment in the following manner. The polyester tire cord was immersed in the same aqueous ammonia solution of m-methoxyphenol/resorcin/formaldehyde cocondensate as described in Example 1, died at 150° C. for 1.5 minutes and then heat treated for 2 hours under an air atmosphere kept at 240° C. The thus treated polyester tire cord was immersed in the same RFL as described in Example 1, dried at 150° C. for 1 minute and then heat treated for 1 minute under an air atmosphere kept at 240° C. The adhesive strength of the adhesive in the resulting adhesive-treated cord was evaluated in the same manner as described in Example 1. The obtained results are shown in Table 3.

EXAMPLE 10

The procedure of Example 9 was repeated, except that the same m-methoxyphenol/5-methylresorcin/formaldehyde cocondensate as used in Example 6 was used in place of the m-methoxyphenol/resorcin/formaldehyde cocondensate. The adhesive strength of the adhesive in the resulting adhesive-treated cord was evaluated in the same manner as described in Example 1. The obtained results are shown in Table 3.

TABLE 3

| Example No. or Comparative example No. | m-Alkoxyphenol and resorcin components in the cocondensate | Adhesive strength (kg/cord) |
|---|---|---|
| Example 1 | m-methoxyphenol.resorcin (124 parts) (62 parts) | 3.20 |
| Example 2 | m-ethoxyphenol.resorcin (138 parts) (62 parts) | 3.16 |
| Example 3 | m-propoxyphenol.resorcin (152 parts) (62 parts) | 3.06 |
| Example 4 | m-butoxyphenol.resorcin (166 parts) (62 parts) | 3.00 |
| Comp. example 1 | m-pentyloxyphenol.resorcin (180 parts) (62 parts) | 2.40 |
| Example 5 | 3-methoxy-5-methylphenol.resorcin (138 parts) (62 parts) | 3.18 |
| Example 6 | m-methoxyphenol.5-methylresorcin (124 parts) (69.5 parts) | 3.22 |
| Example 7 | m-methoxyphenol.5-ethylresorcin (124 parts) (77 parts) | 3.16 |
| Example 8 | m-methoxyphenol.5-propylresorcin (124 parts) (85 parts) | 3.10 |
| Comp. example 2 | m-methoxyphenol-5-butylresorcin (124 parts) (93 parts) | 2.52 |
| Comp. example 3 | resorcin/formaldehyde condensate | 2.20 |
| Example 9 | m-methoxyphenol.resorcin (124 parts) (62 parts) | 3.43 (two stage treatment) |
| Example 10 | m-methoxyphenol.5-methyresorcin (124 parts) (69.5 parts) | 3.43 (two stage treatment) |

COMPARATIVE EXAMPLE 4

The same RFL as used in Example 1 was used as an adhesive liquid, and the adhesive strength of the RFL was evaluated in the same manner as described in Example 1.

EXAMPLES 11-14 AND COMPARATIVE EXAMPLE 5

An adhesive liquid consisting of a mixture of the same aqueous ammonia solution of m-methoxyphenol/resorcin/formaldehyde cocondensate and RFL as used in Example 1 in a variant mixing ratio (weight ratio) in the solid basis was used as an adhesive, and the adhesive strength of the adhesive was evaluated in the same manner as described in Example 1.

The influence of the mixing ratio of the cocondensate/RFL upon the adhesive strength of the resulting adhesive in the above described Examples 11–14 and Comparative examples 4 and 5 is shown in the following Table 4.

TABLE 4

| | m-Methoxyphenol/resorcin/formaldehyde cocondensate | RFL | Adhesive strength in one stage treatment (kg/cord) |
|---|---|---|---|
| Comp. example 4 | 0/100 | | 0.42 |
| Example 11 | 25/100 | | 3.06 |
| Example 12 | 50/100 | | 3.18 |
| Example 13 | 100/100 | | 3.16 |
| Example 14 | 125/100 | | 3.00 |
| Comp. example 5 | 150/100 | | 2.40 |

What is claimed is:

1. An adhesive for polyester fibrous material, comprising an alkoxyphenol derivative/resorcin derivative/formaldehyde cocondensate obtained by condensing a compound represented by the following general formula (I)

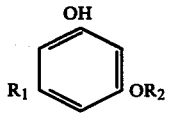

(I)

wherein $R_1$ represents a hydrogen atom or an alkyl group having 1–3 carbon atoms, and $R_2$ represents an alkyl group having 1–4 carbon atoms, and a compound represented by the following general formula (II)

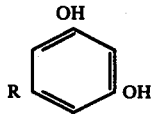

(II)

wherein R represents a hydrogen atom or an alkyl group having 1–3 carbon atoms, together with formaldehyde in the presence of an acidic catalyst.

2. A method of giving an adhesive property to a polyester fibrous material by an alkoxyphenol derivative/resorcin derivative/formaldehyde cocondensate, wherein the polyester fibrous material is treated with an adhesive composition comprising a mixture of an alkoxyphenol derivative/resorcin derivative/formaldehyde cocondensate according to claim 1 and RFL (resorcin/formaldehyde/latex), or the cocondensate is adhered to the polyester fibrous material and then the fibrous material is treated with RFL.

3. An adhesive for polyester fibrous material according to claim 1, wherein said alkoxyphenol derivative/resorcin derivative/formaldehyde cocondensate consists mainly of an alkoxyphenol derivative/resorcin derivative/formaldehyde cocondensate having an average molecular weight of 300–600.

* * * * *